US007766633B2

(12) United States Patent
Nakamura et al.

(10) Patent No.: US 7,766,633 B2
(45) Date of Patent: Aug. 3, 2010

(54) SCROLL COMPRESSOR HAVING A SLIDER WITH A FLAT SURFACE SLIDABLE AND FITTED IN A NOTCH PART OF A MAIN SHAFT

(75) Inventors: Toshiyuki Nakamura, Tokyo (JP); Kenji Yano, Tokyo (JP); Fumihiko Ishizono, Tokyo (JP); Kunio Tojo, Tokyo (JP); Masaaki Sugawa, Tokyo (JP); Masahiro Sugihara, Hyogo (JP); Masayuki Kakuda, Tokyo (JP); Shin Sekiya, Tokyo (JP); Toshihide Koda, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 375 days.

(21) Appl. No.: 11/793,437

(22) PCT Filed: Dec. 22, 2004

(86) PCT No.: PCT/JP2004/019238

§ 371 (c)(1),
(2), (4) Date: Jun. 20, 2007

(87) PCT Pub. No.: WO2006/067844

PCT Pub. Date: Jun. 29, 2006

(65) Prior Publication Data

US 2009/0123315 A1 May 14, 2009

(51) Int. Cl.
*F03C 2/00* (2006.01)
*F03C 4/00* (2006.01)
*F04C 2/00* (2006.01)

(52) U.S. Cl. ..... 418/60; 418/55.1; 418/55.5; 418/57; 418/94

(58) Field of Classification Search ..... 418/55.1–55.6, 418/57, 60, 94, 88
See application file for complete search history.

(56) References Cited

U.S. PATENT DOCUMENTS 5,197,868 A 3/1993 Caillat et al.

(Continued)

FOREIGN PATENT DOCUMENTS

EP 0 682 181 11/1995

(Continued)

OTHER PUBLICATIONS

The Supplementary European Search Report in corresponding application No. 04807595.6 dated Feb. 5, 2009.

(Continued)

*Primary Examiner*—Theresa Trieu
(74) *Attorney, Agent, or Firm*—Buchanan Ingersoll & Rooney PC

(57) ABSTRACT

A scroll compressor includes a compression section having an orbiting scroll with volutes that are substantially symmetrically formed on both surfaces of an orbiting base plate. A main shaft penetrates through and is fixed to a center portion of the base plate. A pair of fixed scrolls is placed on both surfaces of the orbiting scroll, and has volutes which correspond to the respective volutes of the orbiting scroll to form compression chambers. The main shaft has a notch part which is formed at a portion penetrating through the orbiting scroll and fixed scrolls. A slider is provided which has an eccentric hole including a flat slide surface corresponding to the notch part. The slider is fitted to the main shaft where the notch part is formed. The slider is made slidable in a direction orthogonal to a length direction of the main shaft by the flat slide surface.

14 Claims, 10 Drawing Sheets

U.S. PATENT DOCUMENTS

| | | | | |
|---|---|---|---|---|
| 6,379,134 | B2 * | 4/2002 | Iizuka | 418/55.2 |
| 6,758,659 | B2 * | 7/2004 | Ni | 418/55.2 |
| 2003/0194340 | A1 | 10/2003 | Ni | |

FOREIGN PATENT DOCUMENTS

| | | | |
|---|---|---|---|
| EP | 1 148 246 | | 10/2001 |
| JP | 59-224493 | A | 12/1984 |
| JP | 3-175185 | A | 7/1991 |
| JP | 2743568 | B2 | 5/1992 |
| JP | 06101666 | A * | 4/1994 |
| JP | 07-054784 | | 2/1995 |
| JP | 07-197890 | | 8/1995 |
| JP | 8-026860 | | 3/1996 |
| JP | 08-165993 | | 6/1996 |
| JP | 8-170592 | A | 7/1996 |
| JP | 8-326671 | A | 12/1996 |
| JP | 11190286 | A | 7/1999 |
| JP | 2003129969 | A | 5/2003 |
| JP | 2003-307187 | A | 10/2003 |

OTHER PUBLICATIONS

Korean Office Action dated Jun. 10, 2009.
English translation of PCT/ISA/237 for PCT/JP2004/019238.
PCT/ISA/210 for PCT/JP2004/019238 dated Apr. 19, 2005.

* cited by examiner

*Fig.* 5

SCROLL COMPRESSOR HAVING A SLIDER WITH A FLAT SURFACE SLIDABLE AND FITTED IN A NOTCH PART OF A MAIN SHAFT

TECHNICAL FIELD

The present invention relates to a scroll compressor, and more particularly to a scroll compressor having volute teeth on both surfaces of a base plate of an orbiting scroll.

BACKGROUND ART

In a conventional scroll compressor, for example in a case of a vertical type scroll compressor, an orbiting scroll has volute teeth formed on both surfaces of an orbiting scroll base plate, and compression chambers are formed on an upper and a lower surfaces of the orbiting scroll by opposing a pair of fixed scrolls to the respective volute teeth. The orbiting scroll is driven by a shaft penetrating through each of the scrolls. In this case, a penetrating shaft has an eccentric shaft portion, and the eccentric shaft portion is supported by bearing at a penetrating hole of the orbiting scroll base plate for driving and rotating the orbiting scroll. Bearing formed at each penetrating hole of the two fixed scrolls supports the coaxial portions of the shaft at both sides of the orbiting scroll. (see for example, Japanese Patent Laid-Open No. 08-70592)

Patent Document 1: Japanese Patent Laid-Open No. 08-170592

DISCLOSURE OF THE INVENTION

Problems to be Solved by the Invention

The conventional scroll compressors are constructed as described above. In particular, in Patent Document 1, the eccentric distance of the eccentric shaft portion must be adjusted to form small compression chambers between side surfaces of volute teeth of the orbiting scroll and opposite side surfaces of the fixed scrolls. In this case, operating fluid may might leaked from between the opposing side surfaces of the volute teeth an hence deteriorated the function. Hence, cost tends to become high to precisely machine the eccentric distance of the eccentric shaft portion and to precisely assemble the portions.

Further, leakage of the operating fluid may seriously damage the performance in case the refrigerant has small molecular weight such as $CO_2$ refrigerant or in case the refrigerant needs large pressure difference than conventional fluorine refrigerant.

The present invention is made to overcome the above described problems, and has an object to provide a scroll compressor that has favorable assembling property, that improves leakage of the operating fluid between volute teeth, and that has improved sealing and bearing structure.

Means for Solving the Problems

A scroll compressor according to the present invention comprises a compression section provided in a closed container, the compression section including an orbiting scroll and a pair of fixed scrolls. The orbiting scroll has volute teeth formed substantially symmetrically on both surfaces of an orbiting base plate, and a main shaft is penetrated through and fixed at a center portion of the orbiting scroll. The pair of fixed scrolls is opposed to the both surfaces of the orbiting scroll and supports the main shaft by bearing action. Each of the fixed scrolls has volute teeth corresponding to each of the volute teeth of the orbiting scroll to respectively form compression chambers. A motor is provided in the closed container for driving the main shaft, and the main shaft has a notch part at a portion penetrating through the orbiting scroll and fixed scrolls. Further, a slider is provided that has an eccentric hole including a flat slide surface corresponding to the notch part, and is fitted to the main shaft where the notch part is formed. The slider is made slidable in a direction orthogonal to a length direction of the main shaft by the flat slide surface.

Further, a pair of balancers is fitted to the main shaft at both sides of the compression section for canceling imbalance associated with eccentric orbiting movement of the orbiting scroll,

Advantages of the Invention

The scroll compressor according to this invention is constructed as described above. Accordingly in case of assembling a vertical type, for example, the compression section is placed in a lower space of the container, the motor is placed in an upper space, and a glass terminal can be provided at an upper end portion above the motor. Therefore, after the compression section and the motor are all fixed inside the container, a lead wire can be finally connected to the terminal, and therefore, assembling property is improved.

Further, the substantially symmetrical volute teeth are formed on both surfaces of the orbiting scroll and the thrust loads caused by compression of an operating gas are cancelled by each other so that a thrust bearing does not have to be provided.

Accordingly, it can be prevented that an increase in abrasion loss and burning due to a broken oil film occurs due to its low circumferential speed and difficulty in forming oil film, that is caused in case of thrust bearing using a gas such as $CO_2$ gas at high pressure with a high load.

Further, since the compression section is supported by bearing structure on both sides thereof, a moment does not occur to the shaft, and therefore, one-side abutment on the bearing due to tilt of the shaft may be prevented, and an associated increase in bearing loss and burning may be prevented.

Further, as described above, the volute teeth on both surfaces of the orbiting scroll are formed to be substantially symmetrical and have substantially the same heights, and therefore, they are simple in structure and can be formed easily.

EXPLANATION OF THE REFERENCE NUMERALS

1 closed container, 2 motor, 3 compression section, 4 lubricating oil storage chamber, 5 suction pipe, 6 glass terminal, 7 main shaft, 8 discharge pipe, 9 first balancer, 31 orbiting scroll, 31A core part, 31B orbiting base plate, 31D orbiting bearing, 31E seal ring groove, 31F abutment joint, 31G seal ring, 31H tip seal groove, 31J Oldham groove, 31K communication port, 32 compression chamber, 33 upper fixed scroll, 33B main bearing, 34 lower fixed scroll, 34A fixed base plate, 34C main bearing, 34D recessed portion, 34E volute tooth, 34F discharge port, 34G discharge passage, 34H discharge valve, 34J suction port, 35 Oldham joint, 71 notch part, 72 slider, 72A flat slide surface, 72B eccentric hole, 76 oil feed pump, 77 lubricating oil, 78 second balancer, 91 fitting hole, 92 cylindrical body, 93 projected part, 94 flange portion.

BEST MODE FOR CARRYING OUT THE INVENTION

Figure 1:
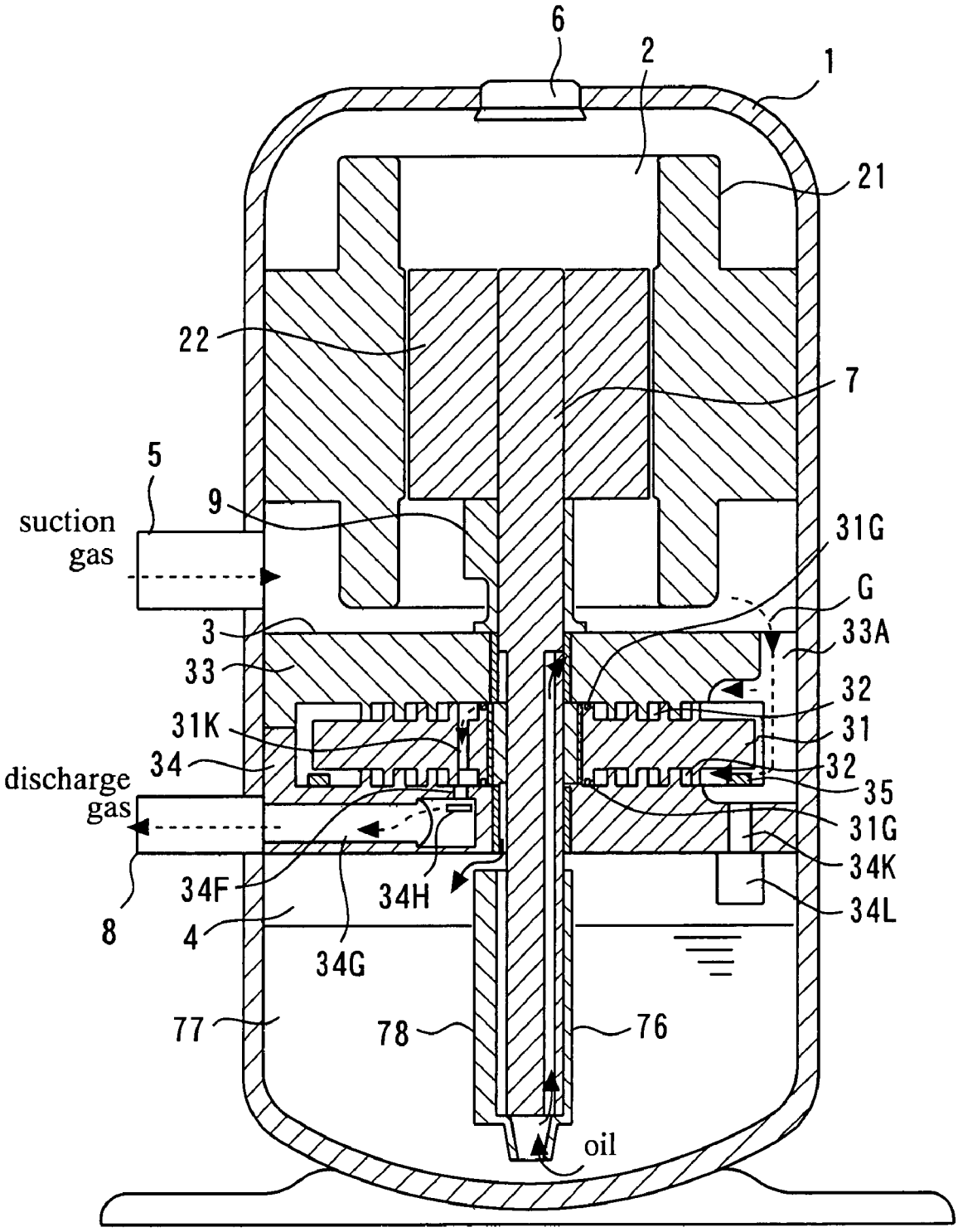
FIG. 1 is a schematic sectional view showing one example of an entire construction in the case of using a vertical container according to a first embodiment.
Figure 2:
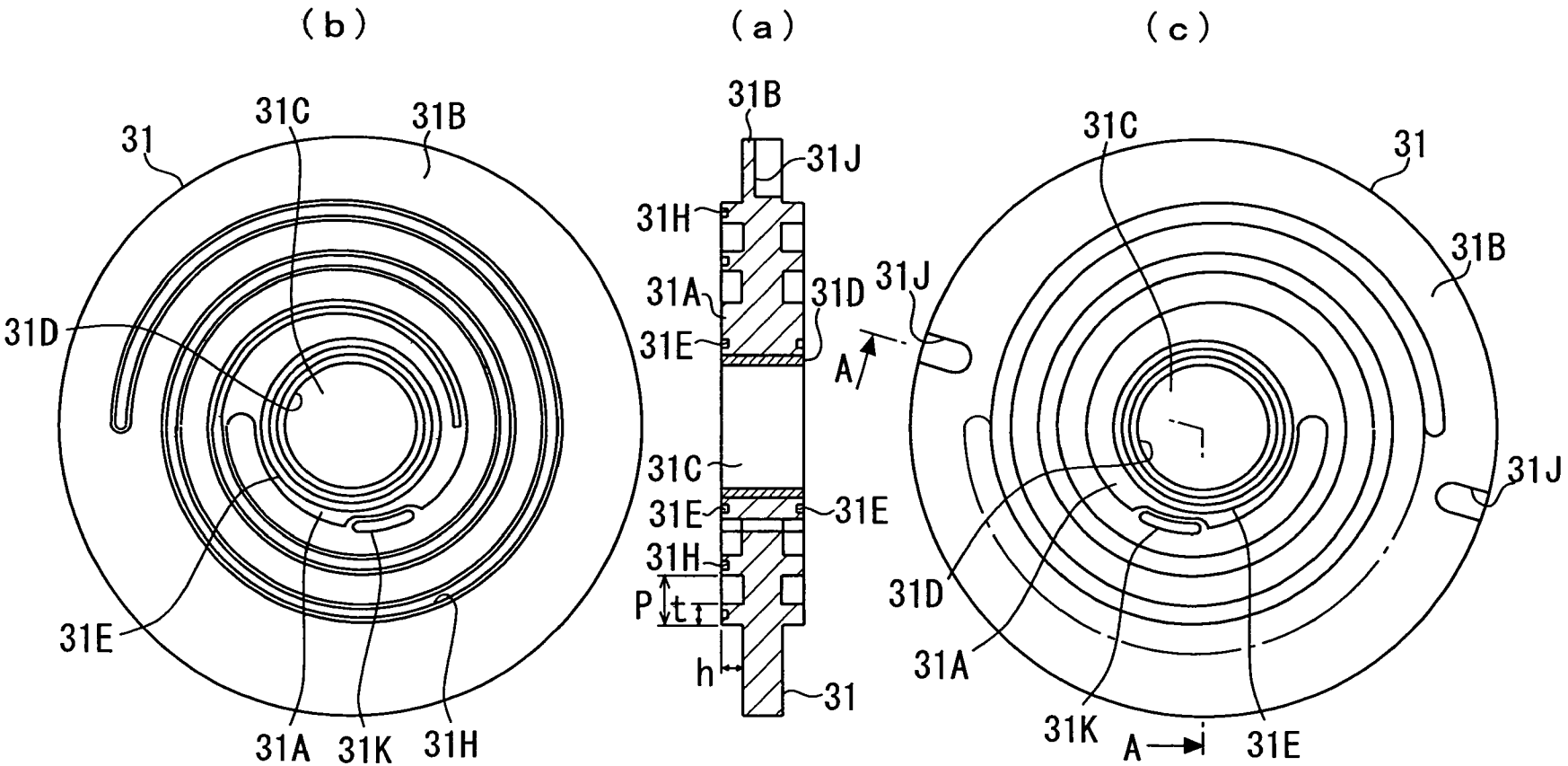
FIG. 2 shows a construction of an orbiting scroll in the first embodiment, (a) is a sectional view, (b) is a plane view showing a construction of the upper, and (c) is a plane view showing a construction of the lower surface.

First, the construction of a compressor, which is a basis of this invention, will be described based on the drawings. FIG. 1 is a schematic sectional view showing one example of an entire construction using a vertical container according to the first embodiment, FIG. 2 shows a construction of an orbiting scroll in the first embodiment, (a) is a sectional view taken along the line A-A in (c) that will be described later, and the left side shows an upper surface while the right side shows a lower surface. (b) is a plane view showing a construction of the upper surface of the orbiting scroll, and (c) is a plane view showing a construction of the lower surface of the same.

Figure 3:
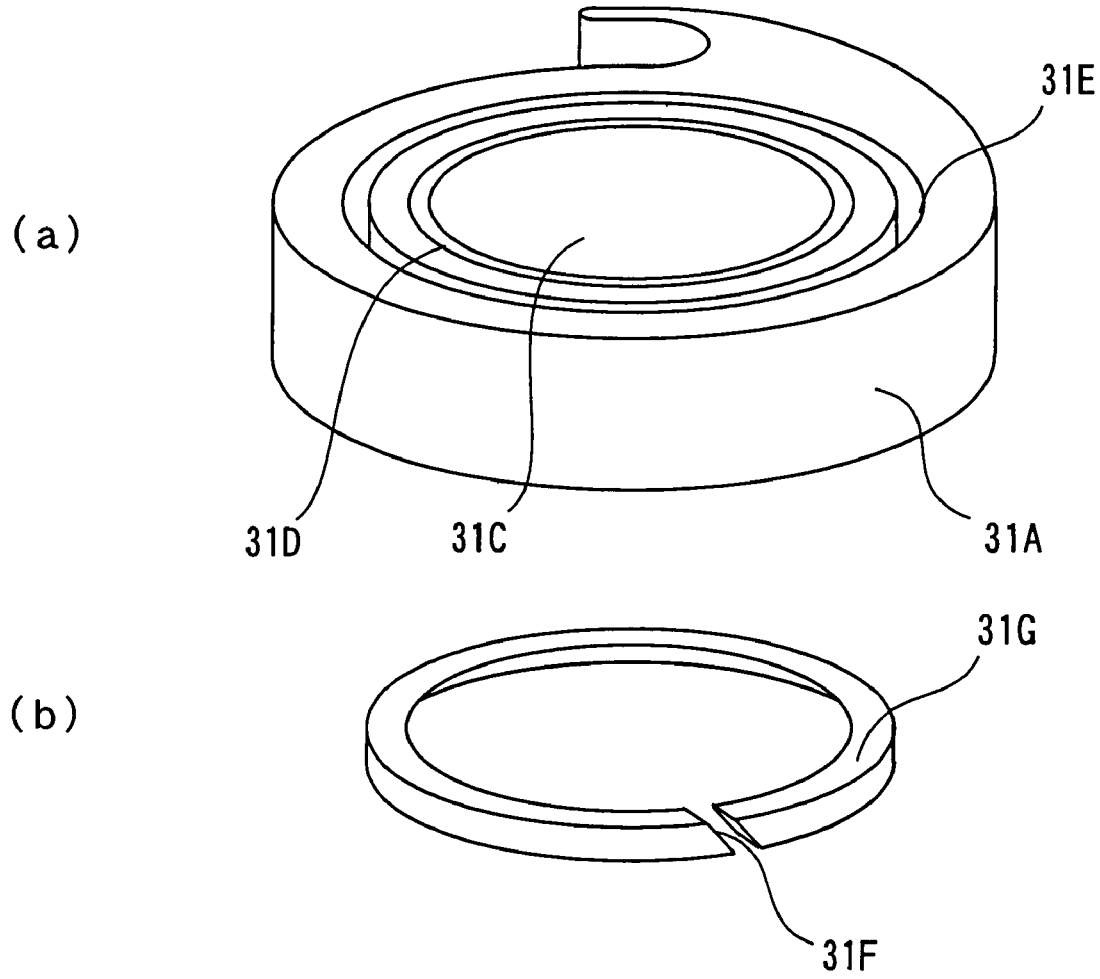
FIG. 3 shows a construction of a core part located in a center portion of the orbiting scroll shown in FIG. 2, (a) is a perspective view, (b) is a perspective view showing a construction of a seal ring each provided at an upper surface and a lower surface.
Figure 4:
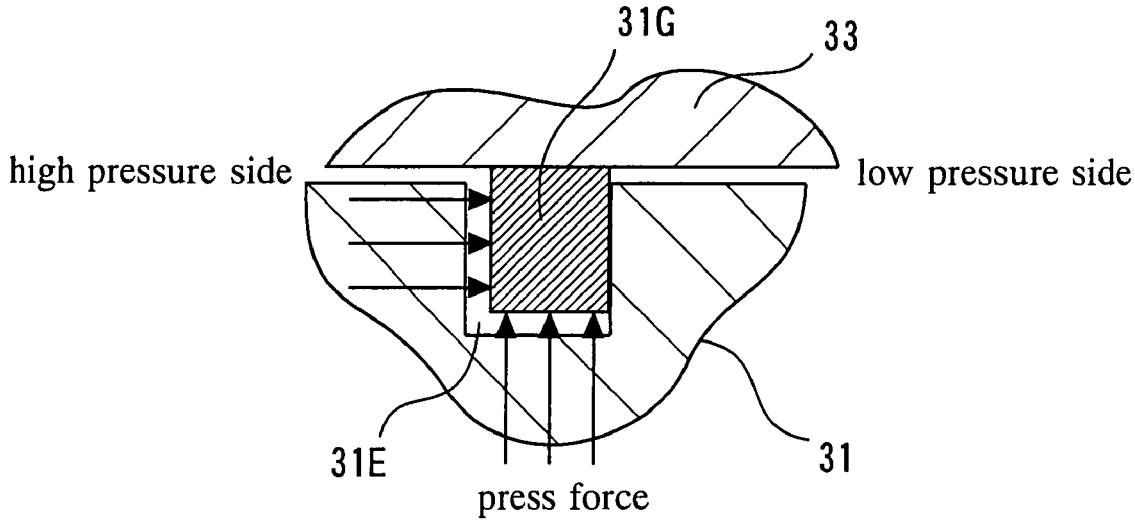
FIG. 4 is an explanatory sectional view for explaining an operational effect of the seal ring in the core part.
Figure 5:
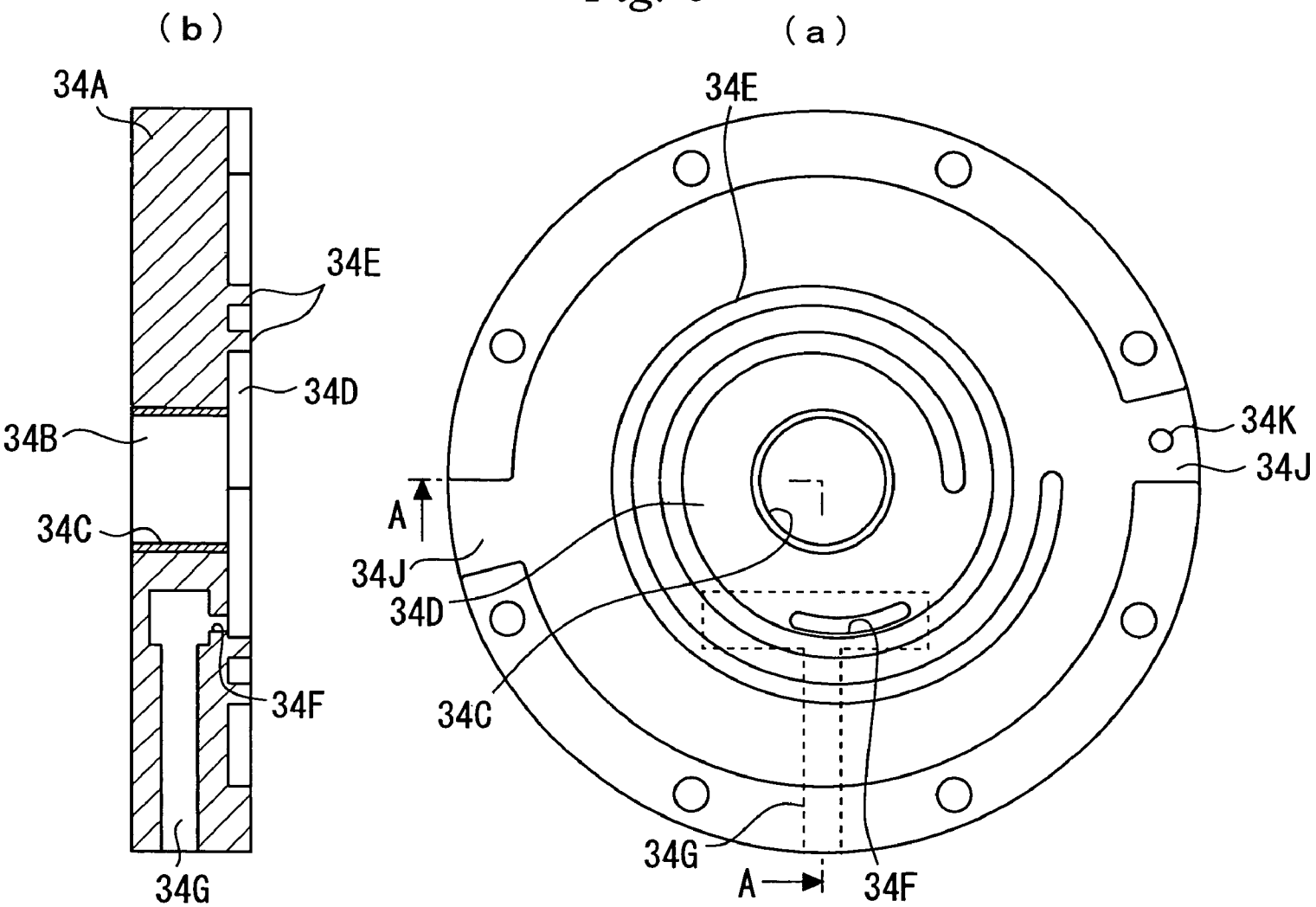
FIG. 5 shows the construction of a fixed scroll at the lower side in FIG. 1 of the fixed scroll s in the first embodiment, (a) is a plane view, and (b) is a sectional view taken along the line A-A in (a)

FIG. 3 shows a construction of a core part located in a center portion of the orbiting scroll shown in FIG. 2, (a) is a perspective view showing the shape of the core part, (b) is a perspective view showing a construction of a seal ring each provided at an upper surface and a lower surface of the core part, FIG. 4 is an explanatory sectional view for explaining an operational effect of the seal ring in the core part, FIG. 5 shows the construction of a lower side fixed scroll in FIG. 1 in the first embodiment, (a) is a plane view, and (b) is a sectional view taken along the line A-A in (a).

In a scroll compressor of FIG. 1, a motor 2 is placed at an upper portion in a vertical closed container 1, a compression section 3 is placed in a lower portion, and a lubricating oil storage chamber 4 is formed under the compression section 3.

A suction pipe 5 is provided for sucking a suction gas in the closed container 1 at an intermediate portion between the motor 2 and the compression section 3, and a glass terminal 6 is provided at an upper end of the closed container 1 at the upper side of the motor 2.

The motor 2 is constructed by a known stator 21 formed into a ring shape, and a rotor 22 supported to be rotatable in the inside of the stator 21. A main shaft 7 is fixed to the rotor 22, and the main shaft 7 penetrates through the compression section 3 to extend to the lubricating oil storage chamber 4. The relationship between the compression section 3 and the main shaft will be described later.

The compression section 3 includes an orbiting scroll 31 having volute teeth formed on an upper surface and a lower surface of an orbiting base plate in substantially symmetrical shape with substantially same heights, an upper fixed scroll 33 which is disposed to be opposed to the upper surface of the orbiting scroll 31 and has an involute tooth which corresponds to the upper surface volute tooth of the orbiting scroll 31 to form a compression chamber 32, a lower fixed scroll 34 which is disposed to be opposed to the lower surface of the orbiting scroll 31 and has a volute tooth which corresponds to the lower surface volute tooth of the orbiting scroll 31 to form the compression chamber 32, and a known Oldham joint 35 which is placed between the lower fixed scroll 34 and the orbiting scroll 31.

The detailed construction of the orbiting scroll 31 will be described with reference to FIG. 2. As shown in this drawing, the orbiting scroll 31 has a core part 31A which forms a center portion and is constituted of a curved line such as an arc, and a disk-shaped orbiting base plate 31B which extends on the outer periphery of the core part 31A.

As shown in the enlarged view of FIG. 3(*a*), in the core part 31A, a hole 31C, through which a main shaft 7 penetrates, is formed in a center portion, and an orbiting bearing 31D is provided on its inner peripheral wall. A seal ring groove 31E is respectively formed on both surfaces of the core part at an outer side of the orbiting bearing 31D, and a seal ring 31G having an abutment joint 31F as shown in FIG. 3(*b*) is inserted in a respective groove. The details of the seal ring 31G will be described later.

In the core part 31A, a volute tooth is usually formed in an involute curve or an arc outward from its center, and the number of turns of the volute tooth is proportional to the compression ratio of the compressor. In the case of using an HFC gas in air-conditioning for example, the compressor is operated at the compression ratio of 3, so that the number of turns of the volute tooth needs to be three or more. But in the case of using a $CO_2$ gas with a low compression ratio, the compressor is operated at the compression ratio of 2, so that the number of turns of volute tooth becomes two or more, and thus it is possible to reduce the number of turns of the volute tooth by one turn as compared with the case of the HFC gas.

Accordingly, by decreasing the turns of the volute tooth by the amount of one turn or more at the center portion, it becomes possible to form the hole 31C in the center portion of the core part 31A for penetrating the main shaft and to provide the orbiting bearing 31D.

This can be applied for any other case where the low compression ratio is a rated condition as well as the case of $CO_2$ gas.

Two or more turns of a volute tooth are formed respectively on the upper surface and the lower surface of the orbiting base plate 31B in involute curves or arcs substantially symmetrically and substantially in the same height as the core part.

"Substantially symmetrical" means that the thickness t, height h, pitch p and the numbers of turns n of the volute tooth shown in FIG. 2(*a*) are substantially equal, and thereby, the reaction force in the thrust direction which occurs at the time of gas compression is made completely or substantially equal.

Therefore, the thrust forces, which act on the orbiting scroll 31 to upward and downward direction at the time of compression, are cancelled out, and the load in the thrust direction becomes substantially zero, so that the thrust bearing can be eliminated.

Since the thrust forces can be cancelled out by each other, the tooth height of the scroll can be made low, and the volute may be enlarged in the diameter direction into a so-called thin pancake shape, whereby the radial direction force can be made relatively small, and reliability of the journal bearing can be enhanced.

The volute teeth on the upper surface and the lower surface are made substantially symmetrical, but in actual a slight difference is made to occur in the gas pressures of the upper and lower compression chambers for example in order to give rise a slight thrust force downwardly.

As a result, the volute tooth at the lower side of the orbiting scroll 31 is brought into pressure contact with the lower fixed scroll 34, and the volute tooth at the upper side has a gap from the upper fixed scroll 33. Therefore, in the volute tooth of the upper side, a tip seal groove 31H is formed at the upper end surface of the volute tooth as shown in FIGS. 2(*a*) and (*b*), and a tip seal 36 (FIG. 6) is fitted inside of it. On the lower side of the orbiting scroll 31, an Oldham groove 31J corresponding to the Oldham joint 35 is formed at an outermost peripheral portion.

The seal ring 31G provided at the core part 31A is formed as a ring which is rectangular in section as shown in FIG. 3(*b*) and has the abutment joint 31F, and is fitted in the seal ring groove 31E shown in FIG. 3(*a*). This seal ring 31G is placed in the core part 31A to separate the main shaft 7 and the orbiting bearing 31D from the center side of the volute tooth in order to prevent leakage therebetween, since at the time of a compressing operation, the main shaft 7 and the orbiting bearing 31D are at a low pressure, while the center side of the volute tooth is at a high pressure.

The separating action is performed by contact sealing of the seal ring 31G by pressure difference. The seal ring 31G is pressed against the right side wall and to the upper side fixed scroll 33 in the seal ring groove 31E being pressed from the high pressure left side and the lower side as shown by the arrow in FIG. 4.

In this case, sliding contact occurs at the surface of the fixed scroll, but the sliding is at a low circumferential speed of a grinding motion in a small radius as the tip seal, and therefore, friction and sliding loss are small.

In the core part 31A, a communication port 31K is formed at the outer side of the seal ring groove 31E. The communication port 31K penetrates through the orbiting base plate 31B in the vertical direction and combines the gases, which are compressed in the compression chambers on both surfaces of the orbiting scroll 31 as will be described later, to flow to a discharge port of the fixed scroll.

The communication port 31K is formed as a long hole along the seal ring groove 31E, or is formed as a plurality of holes disposed adjacently each other to perform substantially equivalent action as the long hole, and is provided at the position which is not across the compression chambers, and always communicates with the discharge port of the fixed scroll, that will be described later.

Next, the detailed construction of the fixed scroll will be described with reference to FIG. 5. FIG. 5 shows one example of the lower fixed scroll 34.

As shown in FIGS. 5(*a*) and (*b*), a hole 34B is formed in a center portion of a fixed base plate 34A through which the main shaft 7 penetrates, and a main shaft bearing 34C is provided on an inner peripheral surface of this hole.

A recessed portion 34D is formed in the peripheral portion of the main shaft bearing 34C, i.e. the center portion of the fixed base plate 34A, and accommodates the core part 31A of the orbiting scroll 31 and allows the orbiting movement of the orbiting scroll 31. At the outer periphery of the recessed portion 34D, a volute tooth 34E is formed in two or more turns in the same size as the volute tooth of the orbiting scroll 31 in the volute curve or the arc but is rotated 180 degrees in phase.

A discharge port 34F is provided in the recessed portion 34D for discharging the compressed gas without crossing the seal ring 31G of the orbiting scroll.

The discharge port 34F is formed as a long hole along an inner side of the innermost volute tooth of the fixed scroll, or is formed as a plurality of holes disposed adjacently each other to perform substantially the equivalent action with the long hole, and is provided at the position which always communicates with the communication port 31K of the orbiting scroll.

Further, a discharge passage 34G is formed which communicates with the discharge port 34F and flows the compressed gas out of the compressor via a discharge pipe 8 (FIG. 1). A discharge valve 34H is placed at a position opposed to the discharge port 34F in the discharge passage 34G as shown in FIG. 1, and prevents a backflow of the discharge gas.

In an outermost peripheral portion of the lower fixed scroll 34, a suction port 34J is provided as a suction inlet of the suction gas to the lower compression chamber. A discharge port 34K (FIG. 1) is provided which communicates from the suction port 34J to the lubricating oil storage chamber 4 at the lower portion of the closed container. A check valve 34L is provided for the discharge port 34K at the side of the lubricating oil storage chamber 4 as shown in FIG. 1.

The check valve 34L is provided to prevent that oil foams with remaining refrigerant and flows out of the compressor when actuating the compressor. The suction path for suctioning gas into the compression chamber is formed as shown by the broken line arrow G in FIG. 1. The suction path includes the suction port 33A formed in the outermost peripheral portion of the upper fixed scroll 33 and the suction port 34J of the lower fixed scroll 34, and the suction gas is introduced into the respective compression chambers formed both on the upper surface and the lower surface of the orbiting scroll 31.

As shown in FIG. 1, the upper end portion of the main shaft 7 is fitted into the rotor 22 of the motor 2. The main shaft penetrates the through-hole of the upper fixed scroll 33, the through-hole 31C of the orbiting scroll 31 and the through-hole 34B of the lower fixed scroll 34 and is immersed at its lower end portion in the lubricating oil 77 in the lubricating oil storage chamber 4.

Figure 6:
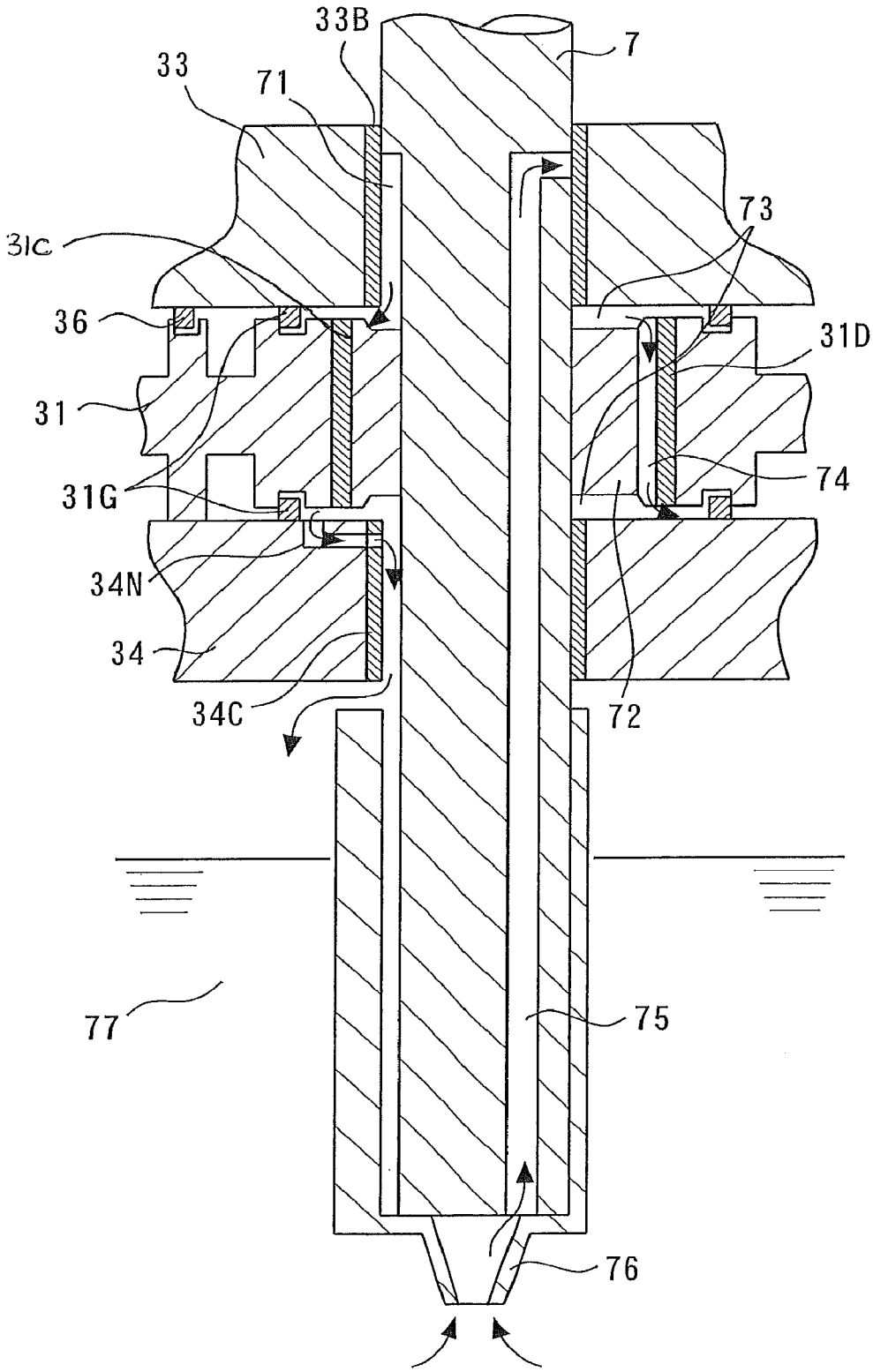
FIG. 6 is an enlarged view of the penetration structure of the main shaft and the compression section and the structure of the lower end portion of the main shaft.

FIG. 6 shows an enlarged view of the penetration structure of the main shaft 7 into the compression section 3 and the structure of the lower end portion of the main shaft 7. Namely, a main shaft bearing 33B is provided between the main shaft 7 and the upper fixed scroll 33. On the surface of the main shaft 7, a notch part 71, having flat surface, is formed from the portion in contact with the main shaft bearing 33B down to the lower end. A slider 72, having an eccentric hole (not shown) with a partially flat surface corresponding to the notch part 71, is fitted to the notch part 71 of the main shaft 7. The outer peripheral surface of the slide 72 is placed to be in contact with the inner peripheral surface of the orbiting bearing 31D of the orbiting scroll 31 shown in FIG. 2. The slider 72, forming an eccentric shaft in combination with the main shaft, drives the orbiting scroll 31 via the orbiting bearing 31D.

On the upper and the lower surfaces of the slider 72, recesses 73 are formed for the paths of lubricating oil. On the surface of the outer peripheral portion of the slider 72, which is in contact with the orbiting bearing 31D, an oil feed groove 74 is formed in the vertical direction and allows the recess 73 on the upper surface to communicate with the recess 73 on the lower surface.

In main shaft 7, an eccentric oil feed hole 75 is formed and extended from the lower end to reach the main shaft bearing 33B of the upper fixed scroll 33. An oil feed pump 76 is provided at. the lower end of the main shaft 7 and is immersed in lubricating oil 77 at the lower end of the closed container 1.

Next, an operation of the first embodiment will be explained.

The gas, which is sucked into the closed container 1 from the suction pipe 5, flows into a part of the motor 2. After cooling the motor 2, the gas is taken into the compression chambers 32 on the upper and lower surfaces of the orbiting scroll 31 from the suction port 33A provided in the outer peripheral portion of the upper fixed scroll 33 as shown by the broken line arrow G.

Thereafter, the orbiting scroll 31 performs orbiting movement, without rotating around its own axis, with respect to the upper and the lower fixed scroll s 33 and 34. A pair of crescent compression chambers, which are formed by the known compression principle, reduce their volumes gradually toward the center. The pair of compression chambers finally communicate with each other in the innermost chambers in which the discharge port 34F is present, and flows are guided outside the compressor through the discharge passage 34G.

Figure 7:
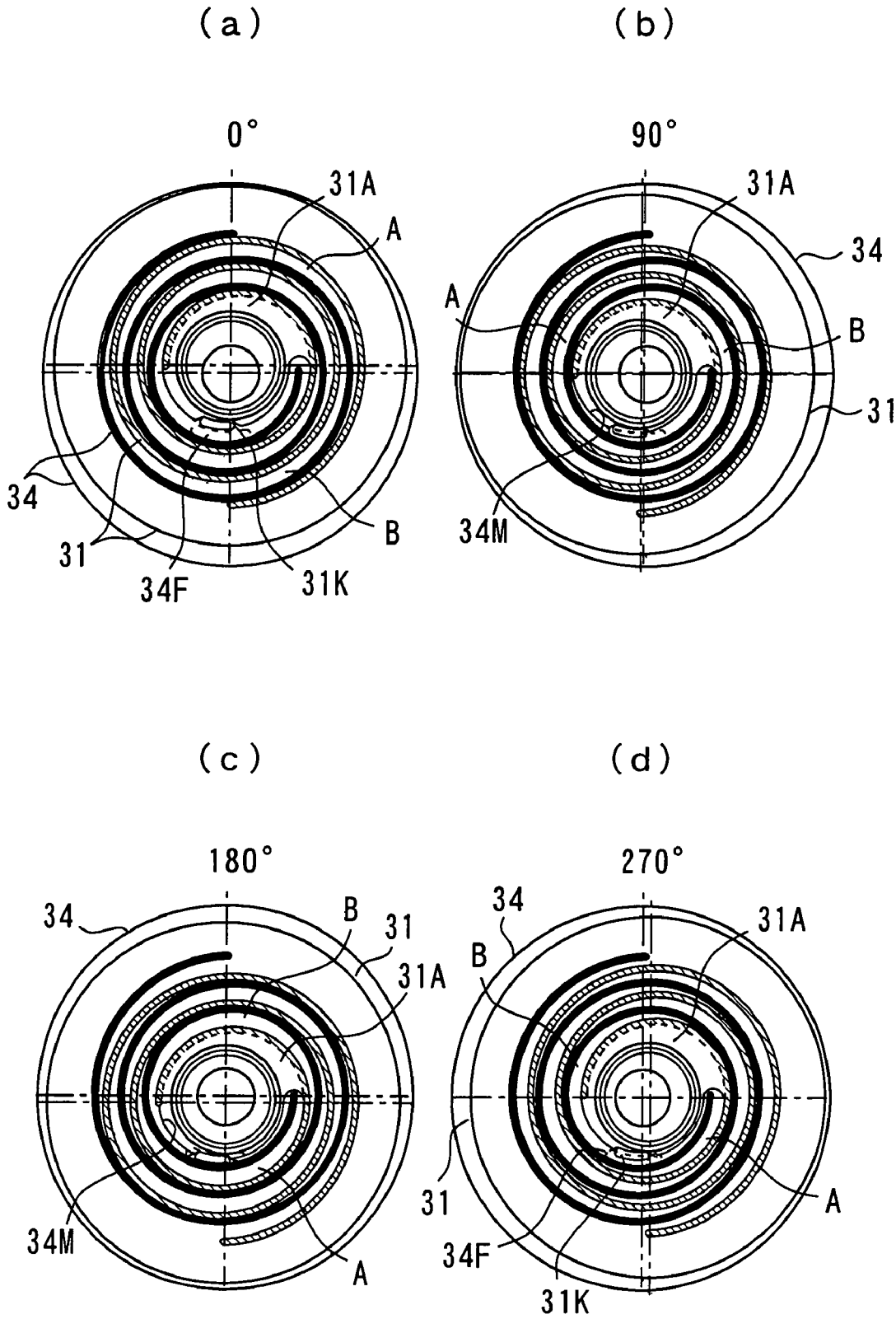
FIG. 7 is an explanatory view to show relation of the orbiting movement of the orbiting scroll and compression chambers.

FIG. 7 shows the process in which a pair of crescent compression chambers, which are formed by the orbiting movement of the orbiting scroll 31, gradually reduce their volumes toward the center. FIG. 7(*a*) shows the state of the orbiting scroll 31 at the orbit angle of 0°. The diagonally slashed portion represents the volute tooth of the orbiting scroll, and the portion painted in black represents the volute tooth of the fixed scroll.

In the state of FIG. 7(*a*), the compression chambers at the outermost periphery complete containing of the gas, and a pair of crescent compression chamber A and B are formed. FIG. 7(*b*) shows the state in which the orbiting scroll 31 orbits by the orbit angle of 90° in the counterclockwise direction.

A pair of compression chamber A and B moves toward the center while reducing in volume.

FIG. 7(*c*) shows the state of the orbit angle of 180°, and FIG. 7(*d*) shows the state of the orbit angle of 270°. In this state, the compression chambers A and B communicate with each other in the innermost chamber in which the discharge port 34F is present, and the gas is discharged from the discharge port 34F.

In FIG. 7, the shape of the core part 31A of the orbiting scroll 31 forms the volute curve up to the portion shown by the broken line, and forms one border of the compression chamber B. The center side from this becomes the curve of the core part and forms the innermost chamber that does not contribute to compression, and forms a border surface in combination with the inner surface of the volute tooth of the fixed scroll 34.

The discharge port 34F is provided in the innermost chamber which does not contribute to compression, and is positioned not to cross the aforementioned seal ring 31G during the compression step, so that a sufficient flow passage is ensured. For that purpose, the curve of the core part and the curve of the inner surface of the volute tooth of the fixed scroll are formed to secure a clearance space in order not to block the discharge port 34F completely with the core part 31A during the compression step.

In a type of compressor in which an integrated volume ratio is fixed as a scroll compressor, compression insufficiency loss occurs in the final discharge step when the operation is performed with a higher compression ratio than a set compression ratio. The compression insufficiency loss means that the pressure in the innermost chamber is higher than the pressure of the compression chambers A and B, when the innermost chamber and the compression chambers A and B communicate each other as in FIG. 7(*d*) for example. Then, backflow occurs to the compression chambers A and B from the innermost chamber, and causes loss of the compression power.

Therefore, the top clearance volume is restrained to a minimum, which is defined as the volume upstream of the discharge valve 34H, namely the total sum of the innermost chamber, the discharge port 34F and the communication port 31K. Further, a little relief portion 34M is formed in the core part 31A. The relief portion 34M is to secure a flow passage by expanding width with reduced radius of the curvature.

Next, oil feed will be described. As shown in FIG. 6, the lubricating oil 77, which is sucked as shown by the arrow from the lower end of the main shaft 7 by the oil feed pump 76, is sucked up through the oil feed hole 75 in the main shaft 7 as shown by the arrow, and is fed into the main shaft bearing 33B of the upper fixed scroll 33.

Thereafter, the lubricating oil passes the flat portion of the notch part 71 formed on the main shaft to flow down and, via the recess 73 formed on the upper surface of the slider 72, flows into the oil feed groove 74 which is formed in the vertical direction on the outer peripheral surface of the slider 72 to lubricate the slider 72.

The oil, which flowed down in the oil feed groove 74, passes via the recess 73 on the lower surface of the slider, and passes through a return hole 34N formed in the lower fixed scroll 34, and flows towards the center direction of the main shaft, and flows down in the notch part 71 of the main shaft 7 again while feeding oil to the main shaft bearing 34C of the lower fixed scroll 34, and is discharged outside the main shaft from the lower end portion of the main shaft bearing 34C as shown by the arrow, and returns to the lubricating oil storage chamber 4.

As described above, the oil feed path forms a circulating closed loop from feeding through discharging without directly contacting the flow of the suction gas.

Accordingly, it is prevented that the oil is caught by the suction gas and flows out of the compressor.

The compressor is constructed as above, and therefore the compressor is suitable, for example, in a case where a heat exchanger volume of an air conditioner is made large for energy saving, in a case where the apparatus is tuned to perform a normal operation with a low compression ratio as an ice thermal storage system for peak-cut and load-leveling, and in a case where a refrigerant such as a $CO_2$ gas is used and normal operation is performed at a low compression ratio for air conditioning operation. A high efficiency of the apparatus can be maintained.

FIRST EMBODIMENT

Figure 8:
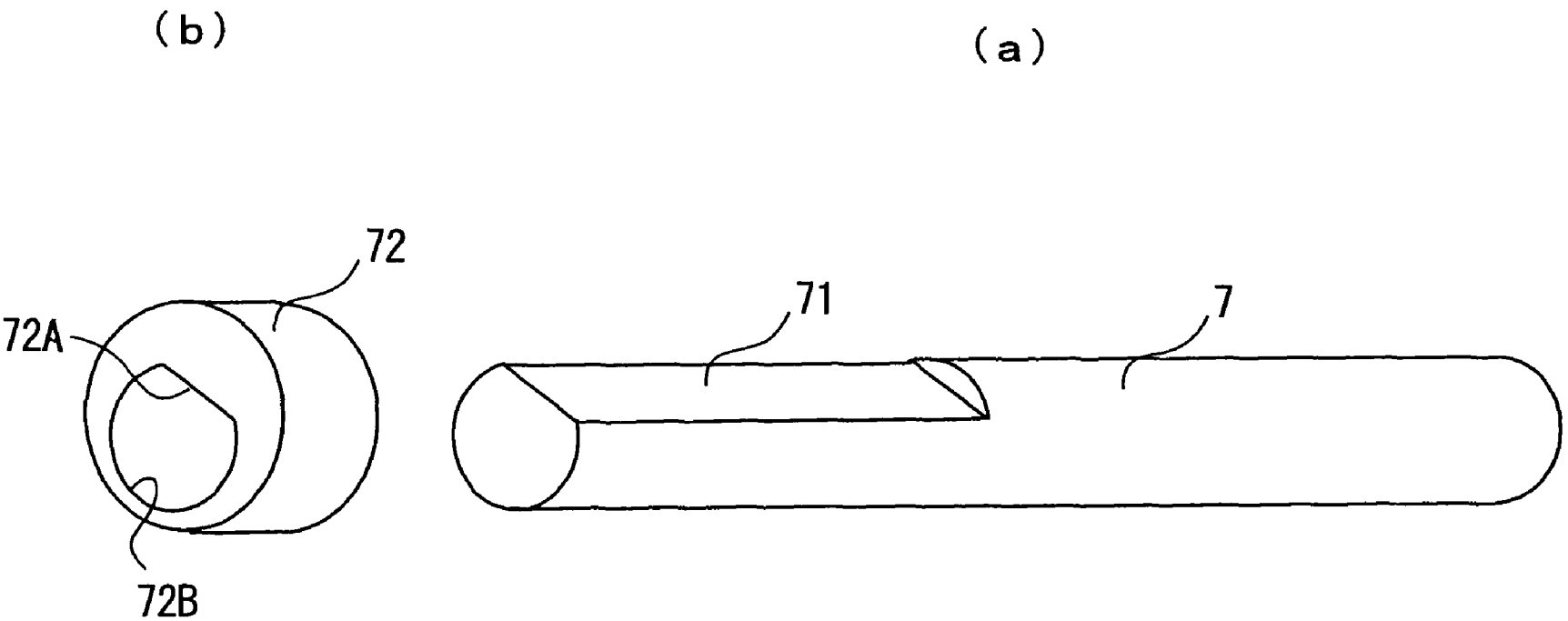
FIG. 8 shows a perspective view of the construction of a main shaft and a slider in the first embodiment of the present invention.
Figure 9:
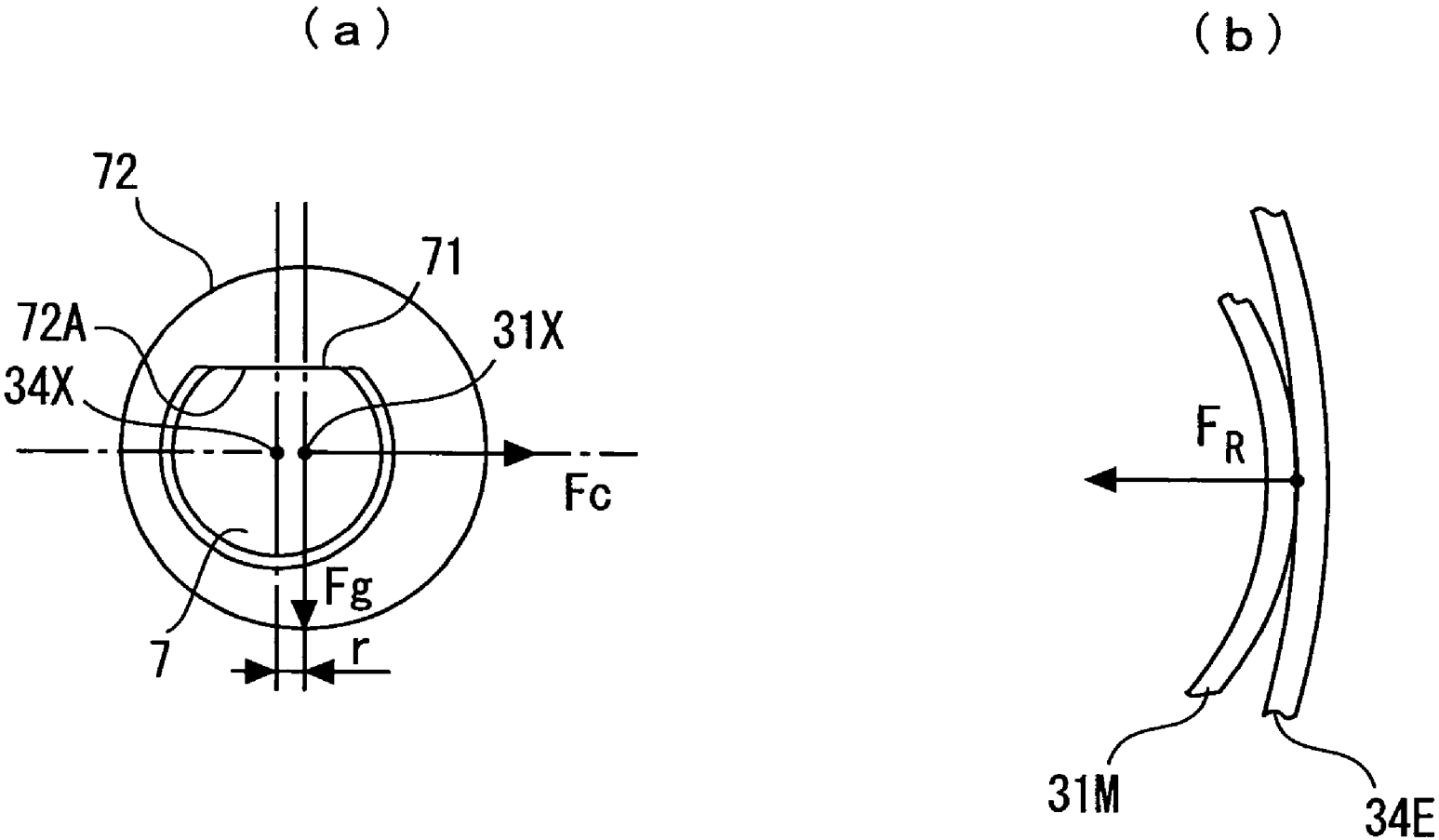
FIG. 9 is an explanatory view for explaining the operation principle of the slider in the first embodiment.

Hereinafter, a first embodiment of the present invention will be described with reference to the drawings. FIG. 8 shows the construction of a main shaft and a slider in the first embodiment, (a) is a perspective view showing the construction of the main shaft, and (b) is a perspective view showing the construction of the slider. FIG. 9 is an explanatory view for explaining the operation principle of the slider. The entire construction of the compressor is the same as FIG. 1, and therefore, duplicated illustration thereof will be omitted.

With regard to the main shaft 7 shown in FIG. 8(*a*), the right end side in the drawing corresponds to the upper side in FIG. 1, and the left end side of the drawing corresponds to the lower side in FIG. 1.

The notch part 71 forms a flat surface on the lower portion of the main shaft 7, and this notch part 71 is formed from the portion in contact with the main shaft bearing 33B of the upper fixed scroll 33 down to the lower end of the main shaft as described in FIG. 6.

As shown in FIG. 8(*b*), the cylindrical slider 72 is prepared that has an eccentric hole 72B and a slider surface 72A corresponding to the notch part 71. The notch part 71 of the main shaft 7 is fitted into the eccentric hole 72B of this slider so that the slide surface 72A and the notch part 71 correspond to each other, and the slider is penetrated through the through-hole 31C of the orbiting scroll 31 as shown in FIG. 6, so that the outer peripheral surface of the slider 72 is in sliding contact with the inner surface of the orbiting bearing 31D.

As for the outside diameter of the main shaft 7 and the inside diameter of the eccentric hole 72B of the slider 72, the outside diameter of the main shaft is set to be a little smaller, as a result of which, the notch part 71 and the slide surface 72A can slide a little parallel with each other.

The operation principle of the slider 72 will be described with reference to FIG. 9. As shown in FIG. 9(*a*), the center of the slider 72 is set as the same as a center 31X of the orbiting scroll 31, and the center of the main shaft 7 is set to correspond to a center 34X of the fixed scroll. Therefore, the center of the slider 72 is eccentric with respect to the center of the main shaft 7 by "r" corresponding to the crank radius, which is equal to the distance by which the volute tooth of the orbiting scroll 31 and the volute teeth of the fixed scrolls 33 and 34 idealistically rotate in contact with each other.

When the main shaft 7 rotates, the orbiting scroll 31 generates a centrifugal force, and the force acts in the direction shown by Fc in FIG. 9(*a*). On the other hand, a reaction force Fg by the gas pressure occurs in the orthogonal direction to this, and therefore, the slider 72 presses the slide surface 72A to the notch part 71 of the main shaft 7, and slides in the Fc direction.

As a result, as shown in FIG. 9(*b*), the volute tooth 34E of the fixed scroll and the volute tooth 31M of the orbiting scroll contact each other and slide until a contact reaction force $F_R$, which is balanced with Fc, occurs, and therefore, contact sealing between the volute teeth of the fixed scroll and the orbiting scroll is realized.

Since the contact sealing between the volute teeth is made by the slider 72 like this, leakage between the volute teeth is restrained to the minimum and a scroll compressor with high compression efficiency can be obtained.

Especially when a gas, which has a large pressure difference and easy to leak such as a $CO_2$ gas, is used, the slider 72 is indispensable.

SECOND EMBODIMENT

Figure 10:
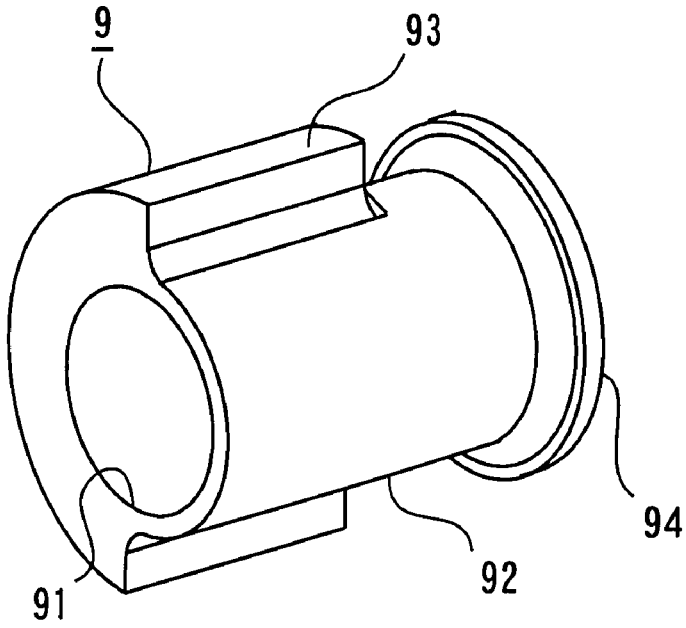
FIG. 10 is a perspective view showing the construction of a first balancer in the second embodiment of the present invention.
Figure 11:
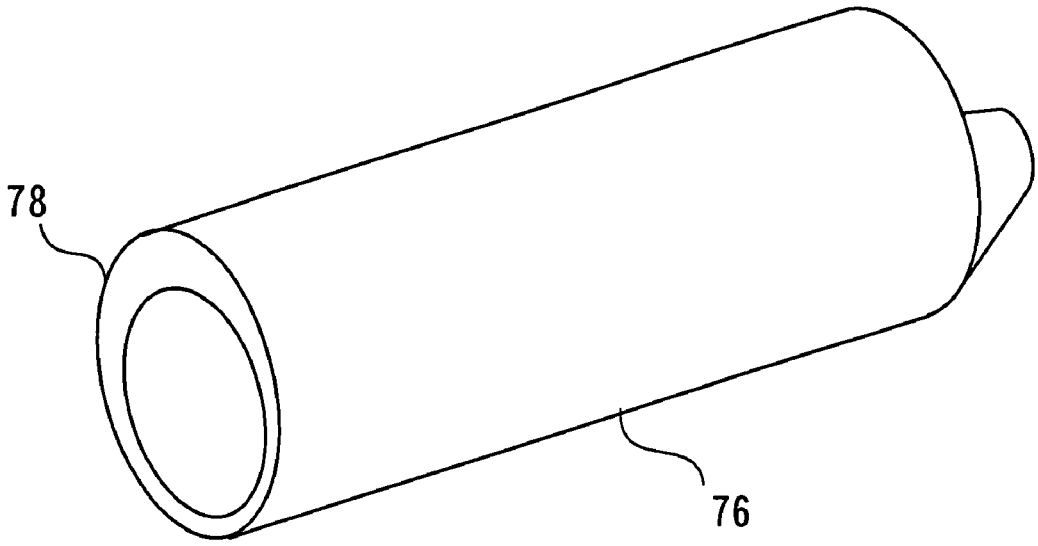
FIG. 11 is a perspective view showing the construction of a second balancer in the second embodiment of the present invention.
Figure 12:
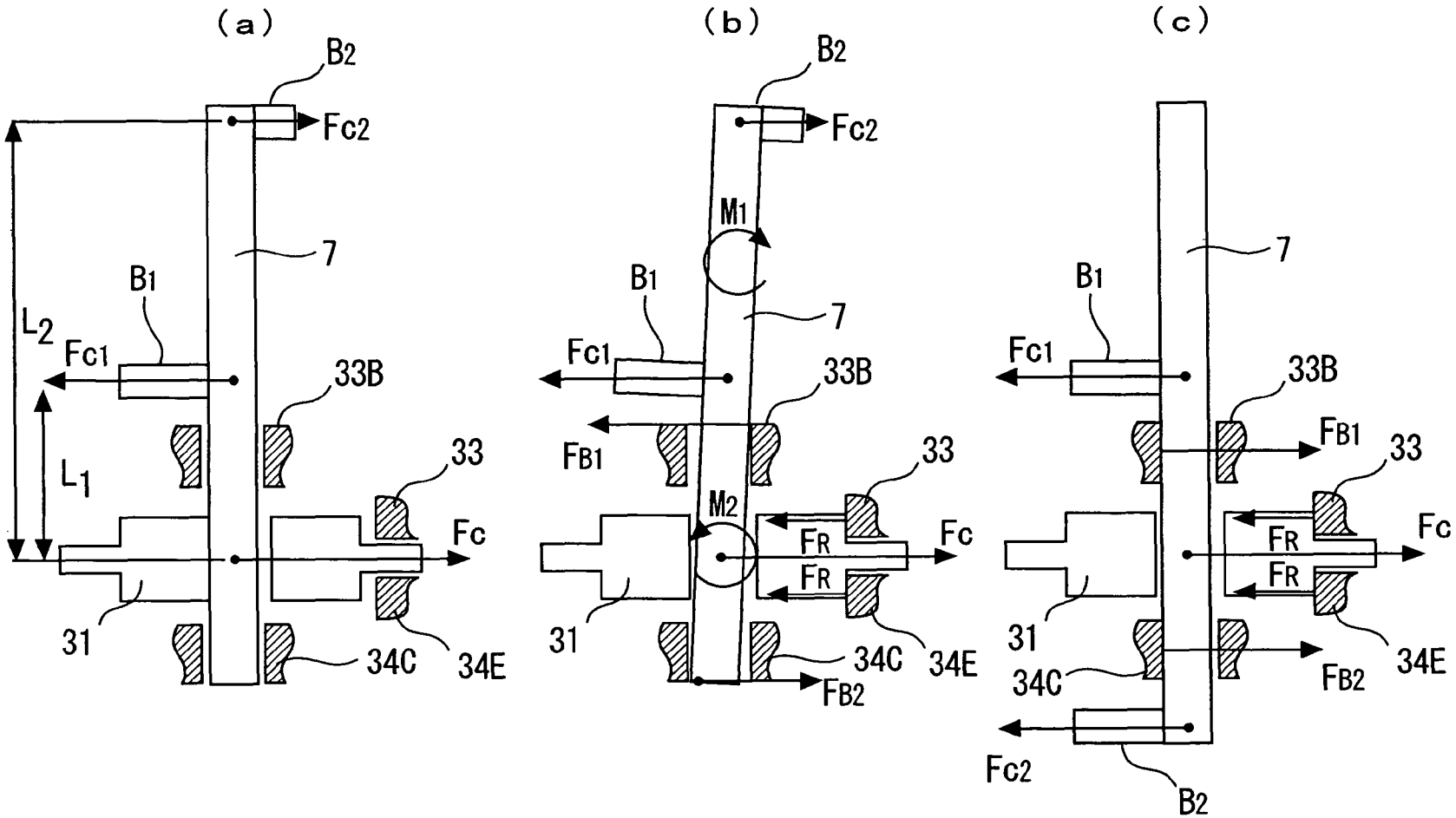
FIG. 12 is an explanatory view for explaining the operational effect of each of the balancers in the second embodiment.

Next, a second embodiment of this invention will be described with reference to the drawings. FIG. 10 is a perspective view showing the construction of a first balancer in the second embodiment, FIG. 11 is a perspective view showing the construction of a second balancer in the second embodiment, and FIG. 12 is an explanatory view for explaining the operational effect of each of the balancers. The entire construction of the compressor is the same as in FIG. 1, and the duplicated illustration thereof will be omitted.

FIG. 10 shows the construction of a balancer for canceling imbalance associated with the eccentric orbiting movement of the orbiting scroll. In the second embodiment, two balancers are mounted for the reason as will be described later, and FIG. 10 shows the first balancer of them.

A first balancer 9 is constructed by providing a projected part 93 which acts as a balancer at one side of a cylindrical body 92 having a fitting hole 91 to the main shaft 7. A flange portion 94, which forms a thrust surface, is formed at one end of the cylindrical body 92.

The first balancer 9 is fitted onto the main shaft 7 between the rotor 22 of the motor 2 and the upper fixed scroll 33 with the flange portion 94 at the lower side so that the first balancer 9 acts as an upper balancer of the compressor.

The first balancer 9 functions as a balancer for the compressor and further functions to position the rotor 22 of the motor 2 in the axial direction by setting the length of the cylindrical body 92. The flange portion 94 at the lower end portion forms a thrust surface and abuts on the upper surface of the fixed base plate of the upper fixed scroll 33 so that it receives the entire weight of the main shaft 7 and the rotor 22 here to be rotated.

FIG. 11 shows the construction of a second balancer 78, and the eccentric thickness portion 78, which acts as a balancer, is formed or fitted on a peripheral surface of the oil feed pump 76 shown in FIG. 1 over the entire length of the oil feed pump.

Specifically, the thickness of the sidewall of the oil feed pump 76 is formed to be partially thick by decentralizing the pump inside and outside diameter along the rotary shaft.

By constructing like this, imbalance rotation is made, and the second balancer is given the function of both the oil feed pump and the lower balancer of the compressor.

The eccentric amount can be made small by forming the balancer over the substantially entire length of the oil feed pump 76. Therefore, even when the eccentric portion is immersed in the oil and rotates, agitation loss of the oil by the eccentric portion can be restrained to the minimum.

FIG. 12 explains an operational effect of the second embodiment. In order to cancel the imbalances of the orbiting scroll, the first balancer B1 and the second balancer B2 are normally disposed at one end side of the main shaft 7 as shown in the drawing (a) to keep dynamic balance and static balance. Each balancer is usually mounted to the end ring of the motor rotor, which is fixed to the main shaft 7, by shrink fitting.

Balancing is set so that Fc=Fc1−Fc2, Fc1×L1=Fc2×L2 as is known.

However, when the orbiting scroll 31 and the fixed scrolls 33 and 34 contact each other at the volute teeth, the centrifugal force of the orbiting scroll 31 is all received by the volute teeth of the fixed scrolls 33 and 34. Therefore, the moment Ml occurs to the main shaft 7 by the Fc1 and Fc2 as in FIG. 12(*b*), so that the moment is received by the upper and lower main bearings 33B and 34C.

As a result, the main shaft tilts and rotates as shown in the drawing, and the main bearings 33B and 34C are easily damaged and worn by so-called one-side abutment.

Thus, as shown in FIG. 12(*c*), namely, as the second embodiment of this invention described above, the two balancers B1 and B2 are disposed at both sides with the main bearings 33B and 34C therebetween, whereby occurrence of moment is eliminated to be able to rotate the main shaft 7 in parallel with the main bearing, and bearing reliability can be enhanced.

INDUSTRIAL APPLICABILITY

This invention can be favorably utilized in an air conditioner or an ice heat storage system that are tuned to be normally operated with a low compression ratio, or in an air conditioner using a refrigerant such as a $CO_2$ gas and having a low compression ratio at normal operation.

The invention claimed is:

1. A scroll compressor comprising:

a compression section provided in a closed container, said compression section including:

an orbiting scroll having volute teeth formed substantially symmetrically on both surfaces of an orbiting base plate, and a main shaft being penetrated through and fixed at a center portion of said orbiting scroll;

a pair of fixed scrolls opposed to said both surfaces of said orbiting scroll, each of said fixed scrolls having volute teeth corresponding to said volute teeth of said orbiting scroll to respectively form compression chambers; and a motor provided in said closed container for driving said main shaft, and wherein said main shaft has a notch part at a portion penetrating through said orbiting scroll and fixed scrolls, and a slider is provided, said slider having an eccentric hole including a flat slide surface corresponding to said notch part, said slider being fitted to said main shaft where said notch part is formed, and said slider being made slidable in a direction orthogonal to a length direction of said main shaft by said flat slide surface.

2. The scroll compressor according to claim 1, wherein said closed container is vertically disposed, said compression section is disposed at a lower portion in said closed container, said motor is disposed at an upper portion in said closed container, a lubricating oil storage chamber is formed in said closed container below said compression section, and an oil feed pump for sucking up a lubricating oil from said lubricating oil storage chamber is disposed at a lower end of said main shaft.

3. The scroll compressor according to claim 2, wherein said closed container is partitioned by said compression section into a motor housing part and the lubricating oil storage chamber, a suction pipe is provided at said motor hosing part, a discharge pipe is provided at said compression section, and an oil feed path is formed, said oil feed path communicating from said oil feed pump, running through inside of said main shaft, opening at a main shaft bearing of an upper one of the fixed scrolls, passing through a main shaft bearing of said orbiting scroll, passing through a main shaft bearing of a lower one of the fixed scrolls and reaching said lubricating oil storage chamber.

4. The scroll compressor according to claim 3, wherein a passage is provided in said compression section for communicating between said motor housing part and said lubricating oil storage chamber, and a check valve, for preventing backflow of said lubricating oil, is provided at an opening of said passage at said lubricating oil storage chamber.

5. The scroll compressor according to claim 3, wherein a suction port, for communicating between said motor housing part and said compression chamber, is provided at an outer peripheral portion of said upper fixed scroll of said compression section.

6. The scroll compressor according to claim 2, wherein a first balancer is provided at said main shaft or said rotor of said motor between said compression section and said motor, and a second balancer is provided at a lower end portion of said main shaft.

7. The scroll compressor according to claim 6, wherein said second balancer is formed integrally with said oil feed pump.

8. The scroll compressor according to claim 1, wherein a suction pipe is provided to said closed container in a vicinity of said compression section, and a glass terminal is provided at an upper end portion of said closed container.

9. The scroll compressor according to claim 1, wherein seal means is provided at said orbiting scroll for sealing the compression chambers formed between said orbiting scroll and said fixed scrolls from an orbiting bearing provided at a main shaft side of said orbiting scroll and main shaft bearings provided between said fixed scrolls and said main shaft.

10. The scroll compressor according to claim 9, wherein said seal means is provided at a core part of said orbiting scroll at surfaces thereof facing to said fixed scrolls.

11. The scroll compressor according to claim 1, wherein balancers, for canceling imbalance associated with eccentric orbiting movement of said orbiting scroll, are fitted to said main shaft at both sides of said compression section.

12. The scroll compressor according to claim 1, wherein said notch part of said main shaft is formed to extend through said main shaft bearings of said upper fixed scroll and said lower fixed scroll.

13. The scroll compressor according to claim 1, wherein said notch part of said main shaft comprises a part of an oil feed path formed in a main shaft bearing.

14. The scroll compressor according to claim 1, wherein said notch part of said main shaft is formed to extend from a portion of the main shaft in contact with a main shaft bearing of an upper one of the pair of fixed scrolls down to the lowest end of the main shaft.

* * * * *